United States Patent [19]

van der Velden

[11] Patent Number: 4,725,724

[45] Date of Patent: Feb. 16, 1988

[54] RADIOGRAPHIC IMAGE INTENSIFIER

[75] Inventor: Johnny W. van der Velden, Heerlen, Netherlands

[73] Assignee: U.S. Philips Corporation, New York, N.Y.

[21] Appl. No.: 841,908

[22] Filed: Mar. 20, 1986

[30] Foreign Application Priority Data

Apr. 26, 1985 [GB] United Kingdom ..... 8510701

[51] Int. Cl.[4] ..... H01J 31/50

[52] U.S. Cl. ..... 250/213 VT; 313/542

[58] Field of Search ..... 250/213 VT; 313/542, 313/543, 544, 527, 530

[56] References Cited

U.S. PATENT DOCUMENTS 3,829,728 8/1974 Gudden et al. ..... 313/543

4,038,576 7/1977 Hallais et al. ..... 313/542

*Primary Examiner*—David C. Nelms

*Assistant Examiner*—Chung K. Seo

*Attorney, Agent, or Firm*—F. Brice Faller

[57] ABSTRACT

An x-ray image intensifier including an input screen 3 having a radiation transparent support 7 on which is applied a fluorescence layer 8 of CsI, a translucent conductive barrier layer 9 which replenishes the photocathode 10 with electrons but tends to reflect incident light especially when made of metal, e.g. of aluminum 7 nm thick which reflects about 50% of the incident fluorescence. The improvement adds first and second intermediate layers 21, 22 of metal oxide e.g. respectively $TiO_2$, MnO, which are semiconductive. The thickness of the first layer 21 adjusts the reflection amplitude to equal that at the photocathode-vacuum interface, and that of the second layer adjusts the relative phase so that the reflections cancel. The first and second layers can be non-conductors such as $Al_2O_3$, however the second layer is then made thin enough, e.g. 25 nm or less, to allow electron conduction by tunnelling to occur.

20 Claims, 3 Drawing Figures

RADIOGRAPHIC IMAGE INTENSIFIER

BACKGROUND OF THE INVENTION

The invention relates to a radiographic image intensifier tube for sensing images formed by penetrating radiation such as X- or $\gamma$-radiation. The tube includes an evacuated housing, an input screen for converting an input radiographic image into an electron image, an output screen for detecting an incident electron image, and means for accelerating electrons emitted from the input screen onto the output screen in a focussed manner. The input screen includes supporting substrate, a radiation conversion layer applied to the substrate for converting photons which form an incident radiographic image into photons of lower energy, an electrically conductive barrier layer substantially transparent to said photons of lower energy, and a photocathode layer for emitting electrons into the evacuated space within the housing in response to the incidence of said photons of lower energy.

Such an arrangement in which the barrier layer is a metal layer is disclosed in the German Published Patent Application No. DT 2,321,869.

In known x-ray image intensifiers for example as disclosed in U.S. Pat. No. 3,838,273, the input screen comprises a substrate such as glass or aluminium on which is deposited an x-ray sensitive radiation conversion layer, commonly referred to as a fluorescence layer or scintillator, and formed for example of an alkali halide with an activator, suitably, sodium or thallium activiated cesium iodide. Such a layer usually has a thickness of approximately 300 micrometers and has a granular structure with a rather uneven surface. A transparent barrier layer is applied to this surface before applying a photocathode layer for two reasons. Firstly, in order to provide a more uniform base for the photocathode layer which must be very thin, namely from about 5 to 25 nm because it is related to the escape depth of photoelectrons from the layer. Secondly, to form a chemical barrier between the radiation conversion layer and the photocathode layer, so as to prevent the occurrence of adverse chemical interactions which could reduce the sensitivity of either or both layers and could occur either during manufacture or during the subsequent lifetime of the device, and of course the barrier layer itself must not react in a similarly adverse manner with the other layers. In the above mentioned U.S. patent, a barrier layer is mentioned which is formed by a layer 0.1 to 1.0 micrometer thick of aluminium oxide or silicon dioxide on which is formed a conductive layer 0.5 to 3 micrometers thick of indium oxide to which the photocathode layer is applied, in order to ensure that the whole of the photocathode layer is maintained at a uniform potential during photoemission.

However, with the introduction of larger input screens up to 350 mm in diameter, the conductivity of this form of barrier layer has been found insufficient to maintain the photocathode layer at a uniform potential throughout its surface during higher intensity photographic recording. It has therefore become desirable to employ a thin conductive translucent metal layer such as aluminium as at least part of the chemical barrier, as for example in the aforementioned DT No. 2,321,869, or by allowing a thin layer of aluminium to be formed over an aluminium oxide barrier layer prior to applying the photocathode layer as mentioned in U.S. Pat. No. 3,825,763 and corresponding reissue number U.S. Pat. No. Re. 29,956.

However, in the case of a metal or metal-like conductive layer such as aluminium, a layer which is thick enough to provide an electrically continuous layer over the uneven surface of the radiation conversion layer and to provide sufficient electrical conduction on the one hand while being thin enough to permit sufficient light to pass through, requires to have a thickness of 4 to 10 nm, and this will reflect from about 20 to 50 percent of the incident light from a sodium activated CsI radiation conversion layer whose wavelength is 420 nm (or about 450 nm in the case of thallium activated CsI), and will further absorb about 18% of the light.

SUMMARY OF THE INVENTION

It is an object of the invention to provide an improved radiographic image intensifier of the kind specified, in which the efficiency of light transfer from the radiation conversion layer to the photocathode layer via a substantially transparent electrically conductive barrier layer, can be increased and maximised.

First and second intermediate layers each having a refractive index greater than unity, are respectively disposed between the radiation conversion layer and the conductive barrier layer, and between the conductive barrier layer and the photocathode layer. The second intermediate layer has an electron transmissivity which is sufficient to enable electrons to pass readily from the conductive barrier layer to the adjacent photocathode layer, the chemistry of the intermediate layers being such that the sensitivity of the respective adjacent radiation conversion and photocathode layers is substantially undiminished thereby. The arrangement is such that the reflection coefficient for photons of lower energy at the interface between the combination of the first intermediate layer and the conductive barrier layer, and the second intermediate layer, is substantially the same as the reflection coefficient at the interface between the photocathode layer and the evacuated space within the tube. The thickness of the second intermediate layer is such that the overall phase difference between the respective reflected waves is substantially equivalent to an overall path difference of $(2N-1)\lambda/2$, where $\lambda$ is the wavelength of photons of reduced energy in the relevant medium and N is a non-zero positive integer. The reflection of photons of lower energy by the conductive barrier layer is thus reduced and the overall photoemissive sensitivity of the input screen is optically maximized relative to an input screen having the conductive barrier layer in the absence of first and second intermediate layers.

The radiation conversion layer can comprise an alkali halide such as cesium iodide and the photocathode layer can comprise an alkali antimonide such as $Cs_3Sb$ (S9) or a trialkali $Na_2KSb$ (Cs) (S20). The conductive barrier layer can comprise a metal layer, for example an aluminium layer whose thickness lies in the range 4–10 nm and is preferably 5 nm. The intermediate layers can comprise metal oxide layers, for example the first intermediate layer can be a layer of $TiO_2$ of thickness 22.5 nm and the second intermediate layer can be a layer of MnO of thickness 30 nm.

Significant loss of light and hence of overall sensitivity, which is caused mainly by reflection and in some cases a certain amount of absorption in a barrier layer having a high electrical conductivity and formed by a metal or metal-like substance e.g. aluminium, can be reduced and minimised by preceding the conductive barrier layer with a transparent layer. The refractive index and thickness of the transparent layer is selected and adjusted so as to cause the amplitude of the reflection coefficient at the conductive barrier layer interface to be the same as the amplitude of the reflection coefficient at the interface between the photocathode layer and the vacuum space of the tube. By following the conductive barrier layer with a transparent layer which maintains a sufficient transmission of electrons and hence an effective electrical conductivity between the conductive barrier layer and the photocathode, and whose layer thickness is such that the phase of the reflection from the photocathode-vacuum boundary is substantially an antiphase with the reflection at the conductive barrier layer interface. It was further realised that this second intermediate layer can also have the effect of slightly reducing the amount of light absorbed in the conductive barrier layer, thus further increasing the proportion of fluorescence that can reach the photoemissive region of the photocathode layer.

Thus, although a relatively long conductive path, i.e. of about 200 mm, would have to be traversed through the conductive barrier layer from a terminal connection at the periphery of the input screen, it was realised that the additional distance a current would then have to travel to reach the photocathode would only be the thickness of the second intermediate layer. Since the thickness of this second layer may be relatively small, e.g. 20 to 30 nm, the conductivity of the layer need not be great to ensure a negligible voltage drop between the conductive barrier layer and the photocathode layer for high brightness image regions generating the maximum photoemission required under working conditions, namely during photography, and a sufficient conductivity can be achieved in this arrangement by certain semiconductive metal oxides such as MnO and $TiO_2$. In the case of such semiconductive material it is sometimes possible to select a material for which band bending occurs at the junction with the photocathode layer in a manner such that the passage of electrons from the intermediate layer to the photocathode layer, is assisted, for example in the case of an MnO layer next to a $Cs_3Sb$ photocathode.

It was also realised that even a non-conductive material can be employed for the second intermediate layer, for example aluminium oxide to a layer thickness of about 25 nm, providing that such a layer permits a correspondingly adequate electron transmissivity to occur as a result of tunnelling.

DETAILED DESCRIPTION OF THE PREFERRED EMBODIMENT

Figure 1:
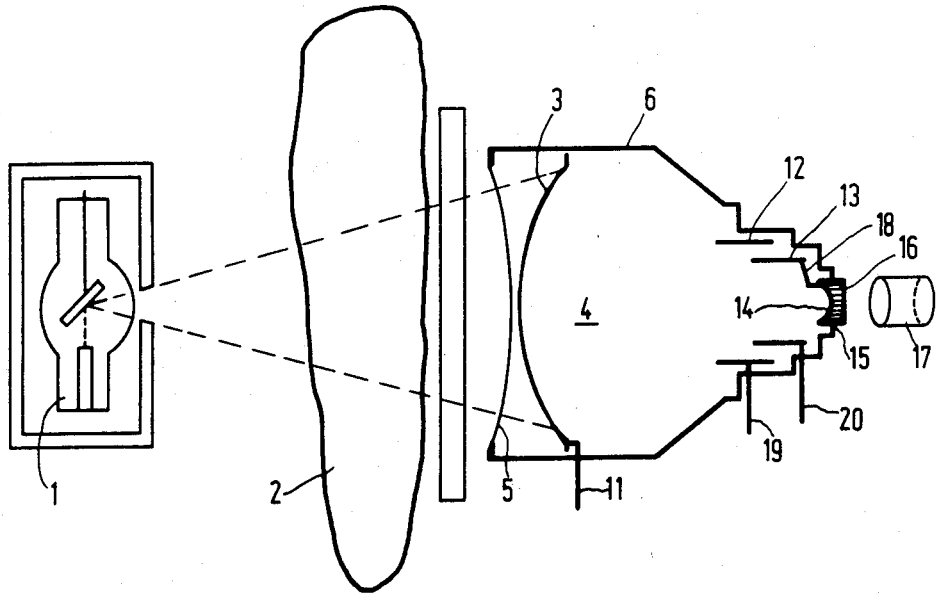
FIG. 1 is a diagram illustrating an x-ray image intensifier which can include an entrance screen according to the invention.

FIG. 1 illustrates diagramatically a conventional form of radiographic system in which an x-ray source 1 irradiates a body 2 under examination. A radiographic image of the irradiated portion of the body 2 is projected onto the input screen 3 of an x-ray image intensifier tube 4 via a thin titanium membrane 5 which forms the end face and entrance window of an evacuated metal envelope 6. The construction of the input screen 3 is illustrated diagrammatically as a sectional detail in FIG. 2, and comprises a thin aluminium supporting sheet 7 to which is applied a radiation conversion layer 8 formed of an alkali halide, suitably cesium iodide activated by sodium or thallium for converting incident x-ray photons into photons of a lower energy corresponding to a wavelength of 420 nm in the case of sodium activation, or about 450 nm in the case of thallium activation.

A conductive barrier layer 9 formed of a metal, suitably a layer of aluminium, is then applied either to the cesium iodide layer 8 directly, e.g. to a thickness of 7 nm, to form a substantially transparent electrically conducting barrier, or after applying an initial layer of aluminium oxide. A photocathode layer 10 formed of an alkali antimonide such as $Cs_3Sb$ referred to as type S-9 or a trialkali antimonide such as $Na_2KSb$ (Cs) referred to as a type S-20 is then applied to the aluminium layer 9 for emitting an electron image in response to the photon-converted radiation from the layer 8 corresponding to the incident radiographic image of the object 2. The photocathode layer, in the case of $Cs_3Sb$, can have a thickness of from 8 to 12 nm and this is determined mainly by the escape depth for photoelectrons which is about 15 nm. A cesium-antimony photocathode layer also absorbs light, and it is therefore desirable to make the layer as thin as possible consistent with maximising the photoemission from the free surface, namely so that as little light as possible is absorbed before reaching that region adjacent the free surface within which generated photoelectrons are most likely to be emitted from the free surface and are least likely to be retained within the layer as a result of scattering.

An insulated electrical connecting lead 11 connects the support 7, the aluminium layer 9 and hence the adjacent surface of the photocathode layer 10 to a suitable potential, for example ground. The walls of the metal envelope 6 form an auxiliary electrode and are connected to a suitable potential. The image intensifier further includes a focussing anode 12 and a final anode 13 for focussing and intensifying the electron image, the latter being connected via a connection 18, to an aluminised layer formed over a fluorescent layer which together make up the output screen 14 for converting the electron image into an optical image. The optical image formed thereby is conducted via a fibre optic plate 15 to the outer surface 16 of an output window from which the output image can be projected by a lens system 17 onto optical sensing or recording apparatus such as a video camera or a film camera, if desired via selection means (not shown). Insulated leads 19 and 20 connect the anodes 12 and 13 to suitable focussing and electron-accelerating potentials derived from a conventional voltage supply (not shown).

The aluminium layer 9 in the known apparatus (FIG. 2) not only acts as a chemical barrier between the radiation conversion layer 8 and the photocathode layer 10, but also provides a high conductivity backing for the extensive layer of photocathode material whose conductivity ca be quite small. This factor becomes especially important when a screen diameter of the order of 360 mm is required over a wide range of emission currents for fluoroscopy and flurography, since an electron replenishment current for the photocathode layer 10 which is supplied via a peripheral terminal connection to the barrier layer 9 which is connected to the lead 11, will have to follow a conductive path of up to 180 mm in length in the aluminium barrier layer 9 in order to maintain different regions of the photocathode layer at substantially the same potential under varying image conditions.

Figure 2:
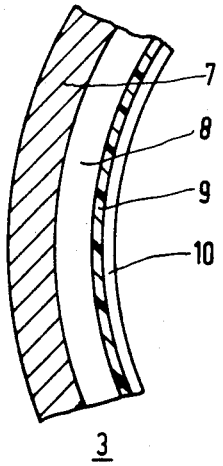
FIG. 2 is a diagrammatic cross section of part of a conventional form of entrance screen for an x-ray image intensifier.

The form of screen hitherto employed and illustrated in FIG. 2, does, however, suffer the disadvantage that a significant proportion of the light emitted by the scintillator layer 8 in the direction of the photocathode layer 10, is reflected or absorbed by the metal layer 9.

Figure 3:
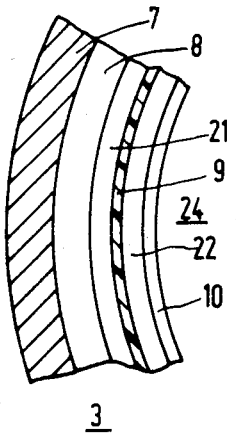
FIG. 3 is a diagrammatic cross section of part of an entrance screen in an x-ray image intensifier according to the invention.

Referring to FIG. 3, this transfer loss is reduced and the overall sensitivity of the scintillator-photocathode combination is restored by disposing a first intermediate layer 21 between the radiation conversion layer 8 and the metal barrier layer 9, and a second intermediate layer 22 between the metal barrier layer 9 and the photocathode layer 10. Both the layers 21 and 22 are formed of a material whose refractive index n is greater than unity, in other words neither layer comprises a layer of metal for which n is less than unity e.g. in the case of aluminium n=0.43. Neither layer 21, 22 must react chemically with the material forming the adjacent radiation conversion layer 8 or the photocathode layer 10 either during the process of manufacture when individual elements may be present, nor during the working life of the device in a manner which would significantly reduce the sensitivity of either layer 8 or 10.

The second intermediate layer 22 must have an electrical conductivity in relation to the thickness of the layer or an electron transmissivity by tunnelling such that electrons can pass readily from the metal barrier layer 9 to the photoemissive layer 10 to maintain the various parts of the layer 10 at substantially the same potential, i.e. that of the metal barrier layer 9, throughout the desired working range of image intensities. This condition can be met by suitable metal oxides which are semiconductors, for the range of layer thickness described hereinafter, and also by some oxides which are non-conductors for a range of thickness within which tunnelling occurs, for example up to about 25 nm in the case of aluminium oxide ($Al_2O_3$).

The optical constants, principally the refractive index, and the thickness of the first intermediate layer 21 in relation to those of the metal barrier layer 9, are selected and adjusted so that the reflection coefficient of the assembly of layers 21 and 9 with respect to reflection at the interface with the second intermediate layer 22, is substantially the same as the reflection coefficient of the assembly of the second intermediate layer 22 and the photocathode layer 10 with respect to reflection at the interface with the vacuum space 24 at the free surface of the layer 10. This latter reflection coefficient will depend on the refractive index of the second intermediate layer 24 and on the thickness of the photocathode layer 10. Furthermore, the thickness of the second intermediate layer 22 must be adjusted so that the overall phase shift between the first mentioned reflection and the latter corresponds to a path difference $(2N-1)\lambda/2$, where $\lambda$ is the wavelength of the photons of reduced energy, i.e. the scintillations, generated by the scintillator layer 8 in response to incident x-ray photons, e.g. 420 nm or 450 nm in the case of sodium or thallium activation respectively, and N is a non-zero positive integer. This arrangement enables use to be made of the normally occurring reflection at the interface of the photocathode 10 and the evacuated space in order to cancel the reflection from the metal layer 9. Since adjustment of the thickness of the first intermediate layer 21 adjusts the amplitude of the reflection from the metal layer assembly, the layer 21 can be regarded as an amplitude-adjusting layer, and by a similar consideration the layer 22 can be regarded as a phase-adjusting layer.

In one embodiment of the invention in which the conductive barrier layer 9 is an aluminium layer whose thickness lies within the range 4 to 10 nm and is preferably 5 nm, the amplitude-adjusting first intermediate layer 21 is a layer of $TiO_2$ whose thickness lies in the range 10 to 30 nm, the phase-adjusting second intermediate layer 22 is a layer of MnO whose thickness lies in the range 20 to 50 nm, and the photocathode layer 10 is a layer of $Cs_3Sb$ whose thickness lies in the range 8 to 12 nm.

The second intermediate layer 22 can alternatively be formed of $TiO_2$ or $SiO_2$. In fact the MnO layer in combination with a photocathode layer 10 whose thickness lies in the range given, provides a reflectivity at the vacuum interface which is slightly low. If $TiO_2$ were substituted, since the refractive index n=2.6 is higher than that of MnO, namely 2.2, a higher reflective coefficient could be achieved especially with thinner photocathodes, and this means that the reflection from the metal layer could be more effectively cancelled. If however a second intermediate layer 22 having a lower refractive index were employed, for example $SiO_2$ (n=1.5), then the higher reflective coefficient match can be achieved when using a thicker photocathode layer 10. An advantage in using MnO for the second intermediate layer 22 is that band bending occurs at the junction surface between the MnO layer and the photocathode layer in a sense which enhances the electron flow to the photocathode 10.

In a first example in accordance with the invention of the arrangement shown in FIG. 3, the layers and their thicknesses are given in Table I and relate to an optimal performance with respect to fluorescence light of wavelength 420 nm, corresponding to a sodium activated CsI radiation conversion layer.

TABLE 1

Example I

| Layer | Material | $\lambda$ = 420 nm Thickness |
|---|---|---|
| Scintillator (8) | CsI | 200 μm |
| First intermediate (21) | $TiO_2$ | 22.5 nm |
| Metal (9) | Al | 5 nm |
| Second intermediate (22) | MnO | 30 nm |
| Photocathode (10) | $Cs_3Sb$ | 8–12 nm |

A second example in accordance with the invention of the arrangement shown in FIG. 3 is set out in Table II which also relates to light having a wavelength of 420 nm.

TABLE II

Example II

| Layer | Material | $\lambda$ = 420 nm Thickness |
|---|---|---|
| Scintillator (8) | CsI | 200 μm |
| First intermediate (21) | $TiO_2$ | 20 nm |
| Metal (9) | Ag | 10 nm |
| Second intermediate (22) | $TiO_2$ | 22.5 nm |
| Photocathode (10) | $Cs_3Sb$ | 8–12 nm |

The various layers can be deposited in succession on the aluminium supporting sheet 7 by corresponding conventional deposition techniques suitable for the relevant layer and its substrate such as vapour deposition, sputtering including d.c. or r.f. magnetron sputtering in vacuo or in the presence where necessary of traces of an appropriate gas, for example oxygen under a suitable low pressure. The radiation conversion layer 8, for example, may be manufactured by vapour deposition and thermal treatment in the manner described in U.S. Pat. No. Re. 29,956.

In a further example of the invention the first and second intermediate layers 21, 22 are both formed of aluminium oxide ($Al_2O_3$), and the conductive barrier layer 9 is formed of aluminium. In forming these layers, aluminium is preferably deposited on the CsI layer 8 by d.c. or r.f. magnetron sputtering. The process of forming the three layers 21, 9 and 22 can then be performed in a single process run by adding oxygen during the formation of the first and the second intermediate layers, and not adding oxygen while the aluminium layer 9 is being formed. The thickness of the second intermediate layer of $Al_2O_3$ is made less than about 25 nm so that electrons can pass sufficiently freely through the layer 22 by the process of tunnelling to maintain all the regions of the photocathode layer 10 at substantially the same potential as the aluminium layer 9 while providing a satisfactory phase match for the returning reflection from the vacuum interface with the photocathode layer 10, as hereinbefore described.

Certain metal oxides also form electrically conductive, substantially chemically inert interstitial compounds, for example indium oxide ($In_2O_3$) and tin doped indium oxide, sometimes referred to as indium tin oxide (ITO), which can be used to form the conductive barrier layer 9 of an x-ray image intensifier in accordance with the invention. In these cases also, the semiconductive or non-conductive metal oxides previously mentioned can be employed to form the first and second intermediate layers. A preferred arrangement is for the first and second intermediate layers 21, 22 to be formed by $Al_2O_3$, the second intermediate layer 22 having a thickness no greater than about 25 nm and such that tunnelling of electrons can readily take place in order to ensure a good conductive connection between the conductive barrier layer 9 and the photocathode layer 10.

What is claimed is:

1. A radiographic image intensifier tube for sensing images formed by penetrating radiation, said tube comprising an evacuated housing, an input screen for converting an input radiographic image into an electron image, an output screen for detecting an incident electron image, means for accelerating electrons emitted from the input screen onto the output screen in a focussed manner, said input screen comprising a supporting substrate, a radiation conversion layer applied to the substrate for converting photons which form an incident radiographic image into photons of lower energy, an electrically conductive barrier layer substantially transparent to said photons of lower energy, and a photocathode layer for emitting electrons into the evacuated space within the housing in response to the incidence of said photons of lower energy, characterized in that a first and second intermediate layer each having a refractive index greater than unit, are respectively disposed between the radiation conversion layer and the conductive barrier layer, and between the conductive barrier layer and the photocathode layer, the second intermediate layer having an electron transmissivity which is sufficient to enable electrons to pass from the conductive barrier layer to the adjacent photocathode layer, said intermediate layers having chemistries which do not substantially diminish the sensitivity of the respective adjacent radiation conversion and photocathode layers, the arrangement being such that the reflection coefficient for said photons of lower energy reflected at the interface between the combination of the first intermediate layer and the conductive barrier layer, and the second intermediate layer, is substantially the same as the reflection coefficient of photons reflected at the interface between the photocathode layer and the evacuated space with the tube, said photons reflected from the interface with said evacuated space travelling on a longer path than the photons reflected from the interface with the second intermediate layer, said longer path defining the overall path difference, the thickness of the second intermediate layer being such that the overall phase difference between the respective reflected photons is substantially equivalent to an overall path difference of $(2N-1)\lambda/2$, where $\lambda$ is the wavelength of said photons of lower energy in the radiation conversion layer and N is a non-zero positive integer, whereby the reflection of said photons of lower energy by the conductive barrier layer is reduced and the overall photoemissive sensitivity of the input screen is optically maximised relative to an input screen including said conductive barrier layer in the absence of said first and second intermediate layers.

2. A radiographic image intensifier tube as claimed in claim 1, characterised in that said second intermediate layer comprises a non-conductive layer whose thickness is such that electron transmissivity is provided by the effect of tunnelling.

3. A radiographic image intensifier tube as claimed in claim 2, characterised in that said second intermediate layer comprises $Al_2O_3$ to a thickness of not greater than 25 nm.

4. A radiographic image intensifier tube as claimed in claim 3, characterised in that said radiation conversion layer comprises an alkali halide and said photocathode layer comprises an alkali antimonide.

5. A radiographic image intensifier tube as claimed in claim 4, characterised in that said first and second intermediate layers comprise respective metal oxide layers.

6. A radiographic image intensifier tube as claimed in claim 5, characterised in that said conducting barrier layer is a metal layer.

7. A radiographic image intensifier tube as claimed in claim 6, characterised in that said metal layer comprises a layer of aluminium whose thickness lies in the range 4 to 10 nm.

8. A radiographic image intensifier tube as claimed in claim 7, characterised in that said first and second intermediate layers both comprise $Al_2O_3$ and the thickness of said second intermediate layer is not greater than 25 nm.

9. A radiographic image intensifier tube as claimed in claim 7, characterised in that said first intermediate layer comprises $TiO_2$ and said second intermediate layer comprises MnO.

10. A radiographic image intensifier tube as claimed in claim 1, characterised in that said radiation conversion layer comprises a layer of CsI, said first intermediate layer comprises a layer of $TiO_2$ of thickness 22.5 nm, said conductive barrier layer comprises a layer of aluminium of thickness 5 nm, said second intermediate layer comprises a layer of MnO of thickness 30 nm, and said photocathode comprises a layer of $Cs_3Sb$ of thickness in the range 8 to 12 nm.

11. A radiographic image intensifier tube as claimed in claim 6, characterised in that said metal layer comprises a layer of silver whose thickness lies in the range 8 to 20 nm.

12. A radiographic image intensifier tube as claimed in claim 11, characterised in that said first and said second intermediate layers each comprise a layer of $TiO_2$.

13. A radiographic image intensifier tube as claimed in claim 1, characterised in that said radiation conversion layer comprises a layer of CsI, said first intermediate layer comprises a layer of $TiO_2$ of thickness 20 nm, said conductive barrier layer comprises a layer of silver of thickness 10 nm, said second intermediate layer comprises a layer of $TiO_2$ of thickness 22.5 nm and said photocathode layer comprises a layer of $Cs_3Sb$ of thickness in the range 8–12 nm.

14. A radiographic image intensifier tube as claimed in claim 5, characterised in that the conductive barrier layer is formed of an electrically conductive interstitial metal oxide.

15. A radiographic image intensifier tube as claimed in claim 14, characterised in that the metal oxide is from the group consisting of $In_2O_3$ and indium tin oxide (ITO).

16. A radiographic image intensifier tube as claimed in claim 15, characterised in that said first and second intermediate layers both comprise $Al_2O_3$ and the thickness of said second intermediate layer is not greater than 25 nm.

17. A radiographic image intensifier tube as claimed in claim 1, characterized in that said radiation conversion layer comprises an alkali halide and said photocathode layer comprises an alkali antimonide.

18. A radiographic image intensifier tube as claimed in claim 1, characterized in that said first and second intermediate layers comprise respective metal oxide layers.

19. A radiographic image intensifier tube as claimed in claim 1, characterized in that said conducting barrier layer is a metal layer.

20. A radiographic image intensifier tube as claimed in claim 1, characterized in that the conductive barrier layer is formed of an electrically conductive interstitial metal oxide.

* * * * *